US006073572A

United States Patent [19]

Gruhn et al.

[11] Patent Number: 6,073,572

[45] Date of Patent: Jun. 13, 2000

[54] FLOATING DOCK

[75] Inventors: Ryan B. Gruhn, Atlantic; Michael E. Irlmeier; Philip R. Littler, both of Adair; Kurt L. McCuen, Casey; Christopher E. Schafer, Adair; Steve Irlmeier, deceased, late of Adair, all of Iowa, by Alverna Irlmeier, legal representative

[73] Assignee: Schafer Systems Inc., Adair, Iowa

[21] Appl. No.: 09/184,147

[22] Filed: Nov. 2, 1998

[51] Int. Cl.[7] ..... B63B 35/44

[52] U.S. Cl. ..... 114/263; 114/266

[58] Field of Search ..... 114/263, 266, 114/267, 249; 405/218, 219, 220

[56] References Cited

U.S. PATENT DOCUMENTS 4,060,048 11/1977 Breheret et al. ..... 114/266
4,811,681 3/1989 Robishaw et al. ..... 114/249

FOREIGN PATENT DOCUMENTS 2725060 12/1978 Germany ..... 114/249

*Primary Examiner*—Ed Swinehart
*Attorney, Agent, or Firm*—G. Brian Pingel

[57] ABSTRACT

The present invention concerns a floating dock that is secure, economical and durable. The dock is comprised of modular floating dock sections coupled together with flanges that fit into receiving sockets on the docking sections. The versatile dock sections can be arranged in a plethora of dock configurations, and modular pieces for end posts and other accessories can be added.

13 Claims, 4 Drawing Sheets

10
11
12
13
14
15
16
17
18
19
20
21
22
23
24
25
26
27
28
40
42
6
9

26
19
17
12
25
24
18
20
15
16

12
15
16
19
25
24
17
18
20
16
25
24

10
36
35

10
13
35
36
32
33
31
30
29
28
27
26
25

FLOATING DOCK

BACKGROUND OF THE INVENTION

1. Field of the Invention

The present invention relates to floating docks, and, in particular, to durable polyethylene docking sections with flanges and sockets that allow the sections to be connected in a variety of configurations.

2. Description of the Prior Art

Floating marine docks are commonly used as a means of providing access to and mooring for boats or as swimming or fishing platforms. Modular or sectional docks are frequently employed for constructing docks of various sizes and configurations. In the past, Styrofoam has commonly been used as the basis for docking modules. These modules, however, are unstable, cumbersome, hazardous to the environment, and are, therefore, limited in their applications. This creates a need for a buoyant modular dock made almost entirely of molded polyethylene or other environmentally stable materials.

In addition, the apparatus connecting modular docks together must be secure enough and strong enough to withstand high stress. Some prior art docks have secured floating dock sections together with joists, locking pins, mounting plates, springs and other fasteners, but each suffers from its own disadvantages. U.S. Pat. No. 5,281,055 utilizes rubber connectors that fit into sockets positioned at the top and bottom edges of the docking members. The lateral and vertical movement that results from the action of wind and waves against floating docks puts considerable stress on the connecting apparatus.

A need exists, therefore, for a modular floating dock with a high strength connecting apparatus that is durable enough to be used in a variety of settings.

SUMMARY OF THE INVENTION

The present invention provides a durable modular floating dock for boating, swimming, fishing, and various other functions. The individual docking members can be connected together by using a connecting member to form a variety of design configurations. The connecting member is comprised of two flanges that each fit into a complementary receiving socket on the two adjacent docking members. The connecting member and docking members can be further secured together by a bolt and nut. Other modular pieces, such as a pole bracket, can be connected to the docking members in a similar fashion.

DETAILED DESCRIPTION OF THE PREFERRED EMBODIMENT

Figures 1, 2:
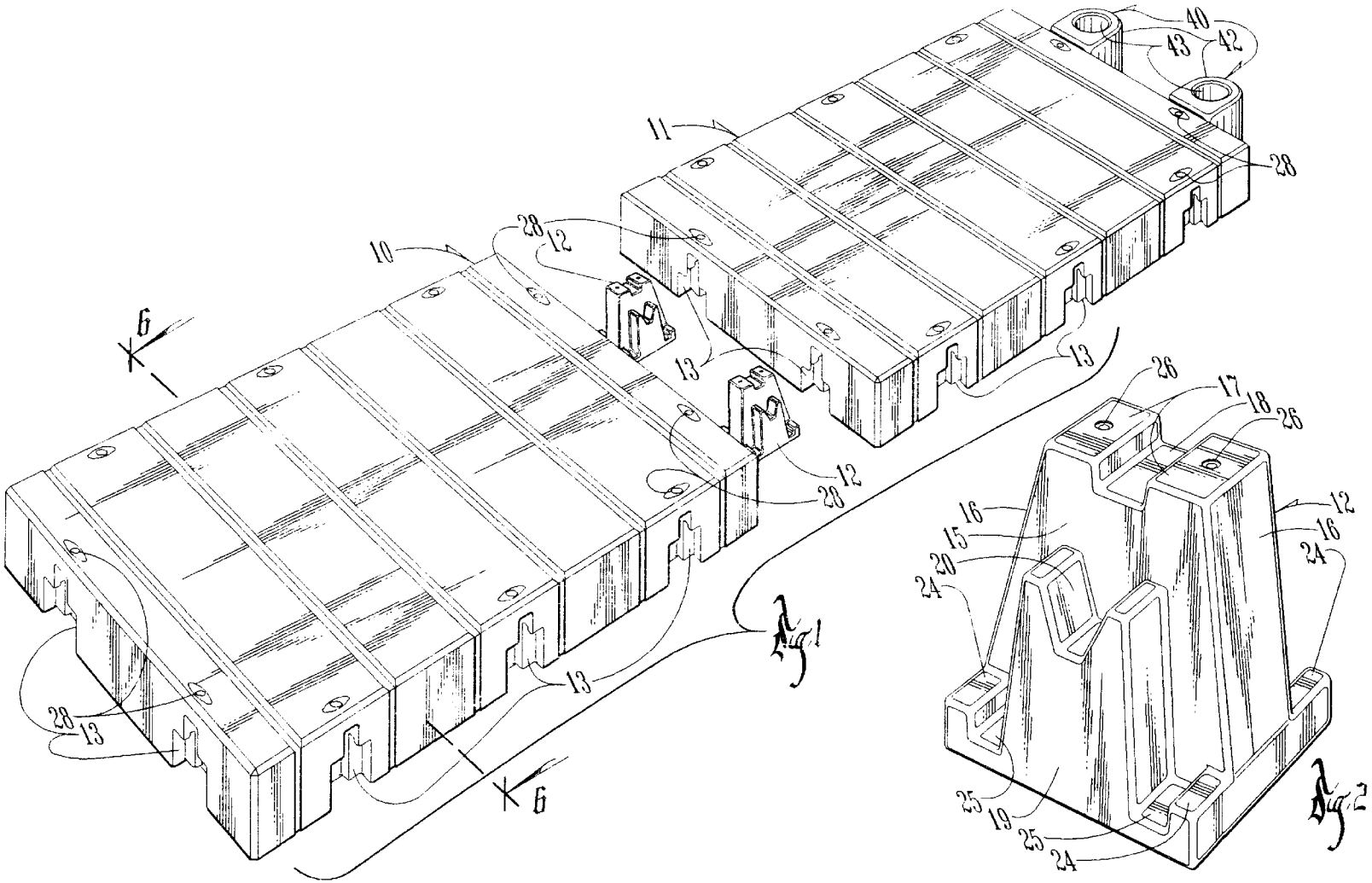
FIG. 1 is a perspective top view of a preferred embodiment of the components of a floating dock of the present invention formed of two docking members and two connecting members that are used to secure the docking members together.
FIG. 2 is a perspective view of a preferred embodiment of one of the connecting members shown in FIG. 1.
Figure 4:
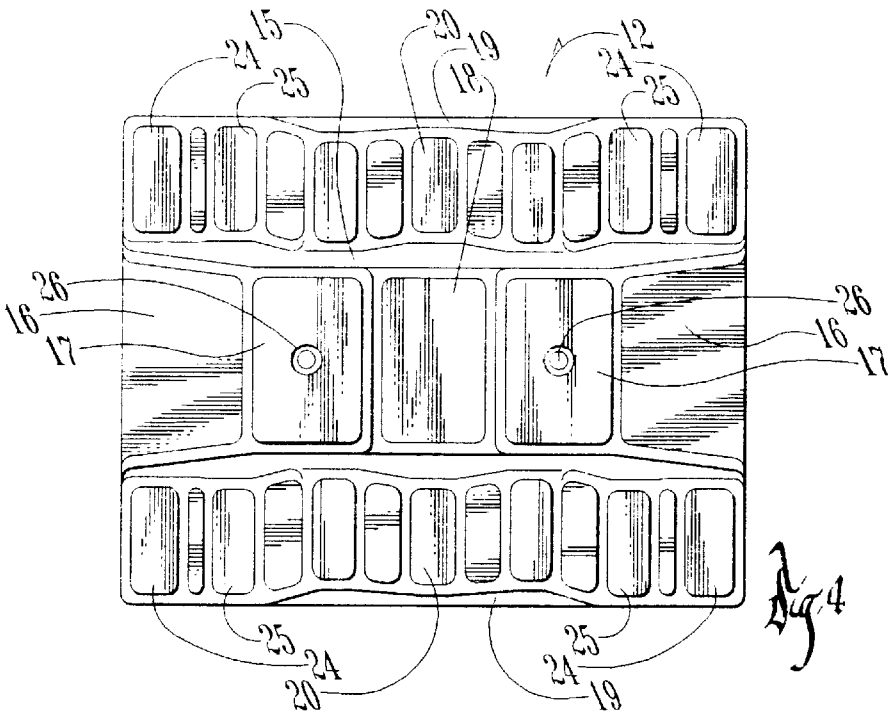
FIG. 4 is a top view of the connecting member of FIG. 4.
Figure 3:
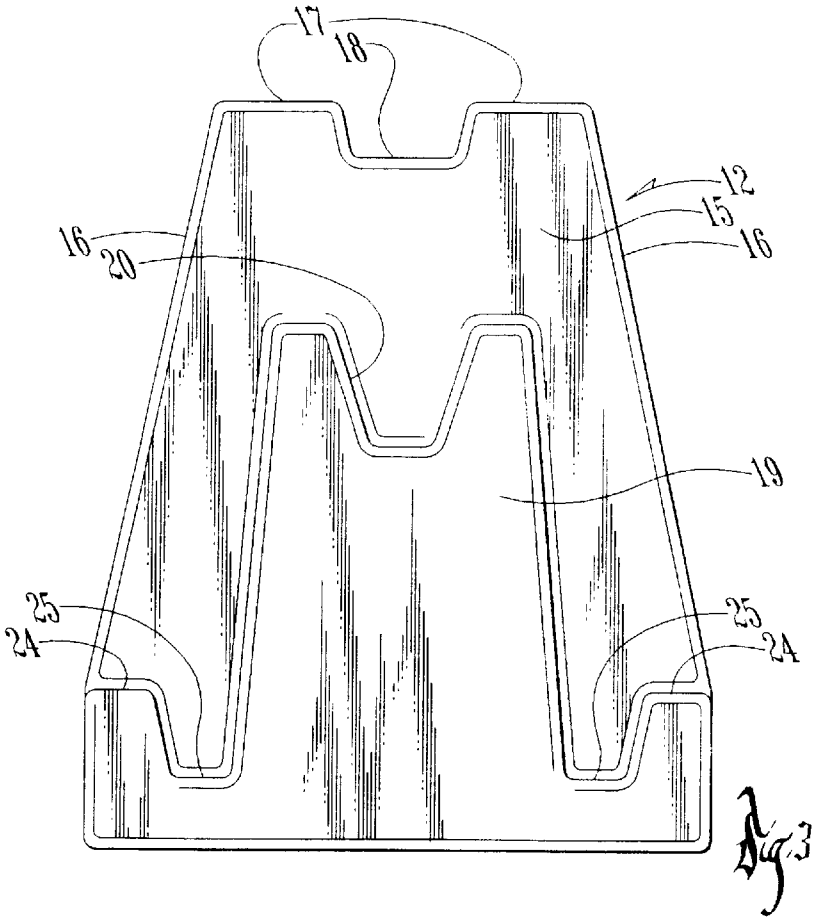
FIG. 3 is a side view of the connecting member of FIG. 4.
Figure 6:
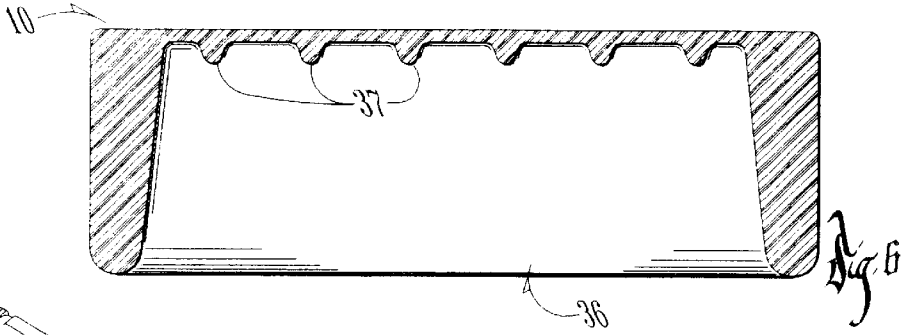
FIG. 6 is a cross sectional view of one of the docking members of FIG. 1 taken along the line 6—6 of FIG. 1.

The present invention provides a floating dock 10, as shown in FIG. 1, comprised of at least two docking members 11 that are preferably connected together by two connecting members 12 to provide a wobble free connection therebetween. However, it should be recognized by those skilled in the art that a single connecting member 12 could be used where conditions allow. Each docking member 11 is, in the preferred embodiment, a one piece molded section and may be of any shape, although a square or rectangular shape is preferred. The dimensions of each docking member 11 can vary depending upon its intended location and design. In the most preferred embodiment, each member 11 is generally rectangular in shape, forty-five inches long, thirty inches wide, ten inches high and weighs approximately fifty pounds.

The docking members 11 can be constructed of any suitable material, but preferably they are made of molded polyethylene, because it possesses strength and durability, is resistant to gas, oil and other contaminants and is also stable on the water. Each docking member 11 is generally hollow. The wall thickness of the docking members 11 can vary, but a range of one-eighth inch in protected areas to three-eighth inch in exposed areas like outside corners, and with a wall thickness on the top (walking) surface of approximately one-fourth inch, is preferred.

Spaced about the perimeter of the docking members 11 are a plurality of receiving sockets 13. It is preferred that the sockets 13 are uniformly spaced along the sides and ends of the docking member 11 so that two docking members can be connected together in a variety of ways. The docking members 11 can have any appropriate number of sockets 13, although in the preferred embodiment, three such sockets are located along the length of each side of the docking member 11 and two sockets are located along each end thereof.

Referring now to FIG. 2, the connecting members 12 are used to attach the docking members 11 together and are complimentary in shape to the sockets 13. Each connecting member 12 has a body 15 with at least two flanges 16, and each flange 16 is received in and interlocks with a receiving socket 13. Each flange 16 has an inwardly tapered post section 17 adjacent to which is a top recess 18. In the preferred embodiment, the body 15 further includes two side members 19 that are somewhat similar in shape to the flanges 16 and extend from opposite sides thereof. Each side member 19 is notched to form a recess 20, and the flanges 16 have lower ledge portions 24 that are spaced from the side members 19 to form bottom recesses 25.

In the preferred embodiment, the top of each post section 17 contains a threaded bore 26 molded therein. Securing means, such as a bolt (not shown), can then be positioned through holes 28 in the top of the docking member 11 and secured in the bores 26. This serves to semi-permanently secure the docking member 11 and its associated connecting member 12 together.

Figure 5:
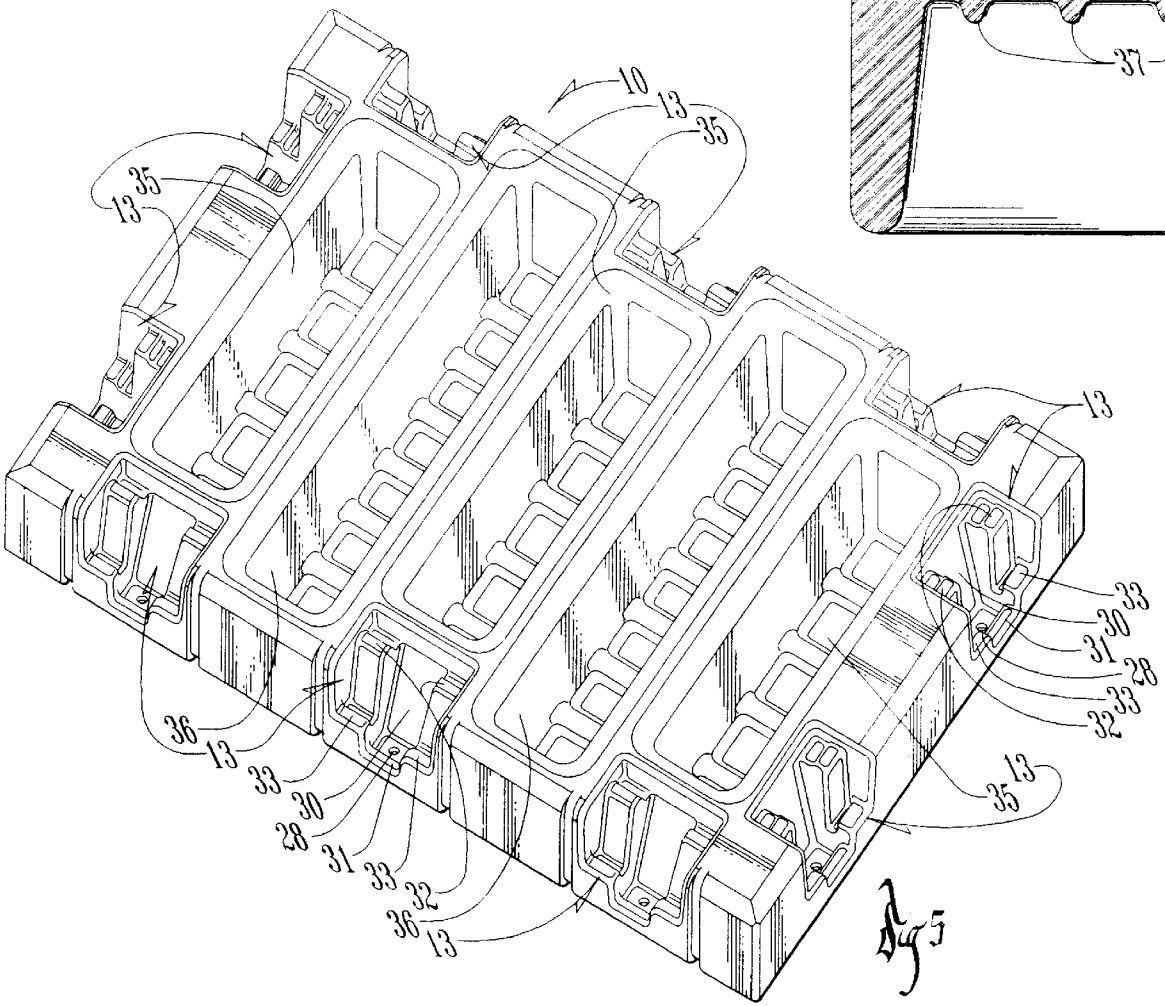
FIG. 5 is a perspective bottom view of one of the docking members of FIG. 1.

As shown best in FIG. 5, the sockets 13 each comprise a central, vertically oriented, tapered recessed portion 30 that is complementary in shape to one-half of a connecting member 12, as described below so that they fit together in an interlocking relationship. At the top of each socket 13 is a top overhang 31 intended to fit into the top recess 18 of one of the connecting members 12. In the preferred embodiment, the sockets 13 further comprise two bottom overhangs 32 that interlock with the bottom recesses 25 of one of the members 13, and two side overhangs 33 that interlock with the recesses 20 in the side members 19 to thereby provide an efficient, effective and durable means for interlocking the docking members 11 together.

Figure 7:
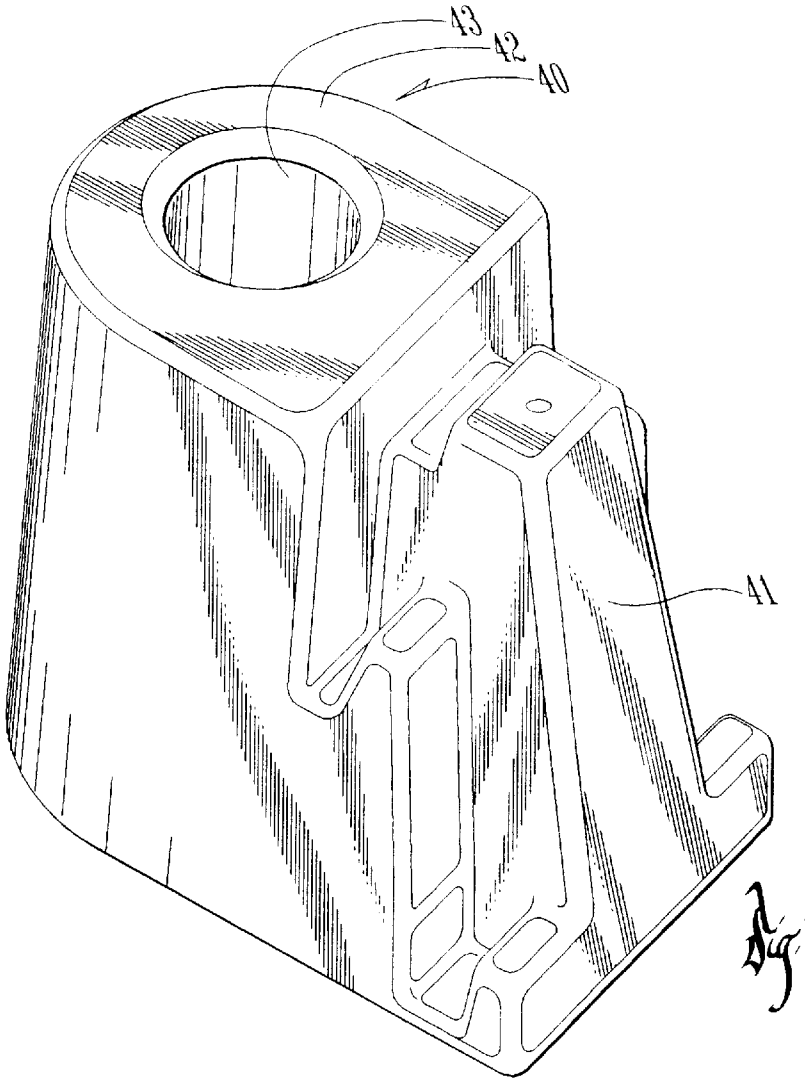
FIG. 7 is a perspective view of a pole bracket that can be attached to a docking member.

To increase the structural strength of the docking members 11, a member of aligned troughs 35 and 36 (FIG. 5) of a generally rectangular shape extend from the bottom upward toward the top of each docking member 11. These troughs 35 and 36 each define a cavity in the docking member 11, so that air is captured within the trough 35 when the docking member 10 is positioned in the water. The sides of the troughs 35 and 36 also provide structural support against downward or lateral pressure applied to the docking member 11. In the preferred embodiment, the troughs 35 and 36 comprise a total of five and extend along the width of the docking member 11. There are three of the troughs 35, which are shorter than the troughs 36 and extend between the receiving sockets 13 on their respective sides. There are two of the long troughs 36 that are unencumbered by the receiving sockets 13 so as to extend from side to side. In the preferred embodiment, the short troughs 35 are approximately nineteen inches long, four inches wide and nine and one-half inches deep, and the long troughs 36 are approximately twenty-five inches long, four inches wide and nine and one-half inches deep. As shown by FIGS. 5 and 7, the ceilings of the troughs 35 and 36 are formed with transverse ribs 37 to improve the flow of plastic during molding and productability of the members 11.

Figure 8:
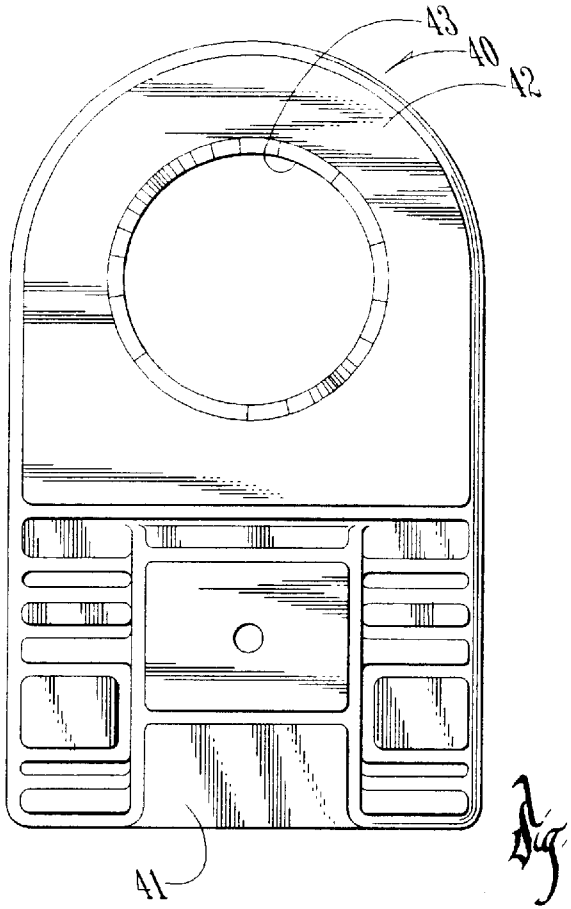
FIG. 8 is a top view of the embodiment of FIG. 7.

To stabilize the dock 10, it is highly preferable to utilize one or more stabilizing poles (not shown) to brace the floating dock. Each stabilizing pole can be secured to the dock by the use of a pole bracket 40 as shown in FIGS. 7 and 8. Each of the members 40 is comprised of a flange section 41 and a pole section 42 that contains a pole hole 43. The flange section 41 is similar in shape to the flanges 16. Thus, each pole bracket 40 can be secured in one of the receiving sockets 13. Other types of attachments and accessories, such as gangways, ladders, boat moorings, and floating dry docks for watercraft (all not shown) can also be attached to the dock by the use of members that interlock with the receiving sockets 13.

In application, the docking members 11 are connected together with the use of connecting members 12 into a desired configuration. Any docking member 11 can be secured to the shore through the use of arms, cables, gang planks or other means. The present invention thus provides a complete floating dock that does not require additional elements for use, such as boat bumpers or wood planking, or additional parts for assembly. The polyethylene docking members 11 are durable, stable and have a long life. The shape of the flanges 16 and receiving sockets 13 ensure that the docking members 11 will remain securely attached by the connecting members 12 so that the docking members 11 will not separate during use. The connecting members 12 also result in a tight fit and a very small gap between the docking members 11, and this increases the ease and safety of walking on the dock 10.

While a preferred embodiment of the present invention has been described, it should be understood that various changes, adaptations and modifications may be made therein without departing from the spirit of the invention and the scope of the appended claims.

What is claimed is:

1. A floating dock comprising:

(a) at least two docking members having a top, a bottom, and four sides, each docking member containing a plurality of receiving sockets spaced apart along the sides thereof from the bottom to a point below the top;

(b) at least one connecting member having a body with two flanges, each such flange being complementary in shape to and receivable in one of said sockets of one of said docking members for securing said members together;

(c) each of said receiving sockets has a vertically oriented tapered portion with a top overhang; and (d) each of said flanges has a vertically oriented tapered rectangular post section with at least one top recess positioned to align with said top overhang.

2. The floating dock of claim 1 wherein:

(a) each of said receiving sockets further includes at least one side overhang portion; and (b) said body further includes at least one side member, and each such side member contains a side recess positioned to align with said side overhang.

3. The floating dock of claim 2 wherein:

(a) each of said receiving sockets has at least one bottom overhang portion; and (b) each of said flanges has at least one bottom ledge portion, and each such ledge portion is spaced apart from said side members to form a bottom recess.

4. The floating dock of claim 1 wherein the top of each docking member contains a hole positioned above the receiving socket, and a securing means is positioned through the hole and extended downward into the flange of the connecting member to semi-permanently secure such members together.

5. The floating dock of claim 4 wherein the securing means is associated with a nut positioned in the flange of the connecting member.

6. The floating dock of claim 1 wherein each docking member comprises one unit made of polyethylene.

7. The floating dock as in claim 1 wherein the bottom of the docking member has at least one trough of generally rectangular shape that extends upward toward the top of the docking member.

8. The floating dock of claim 7 wherein the base of said trough defines a cavity in the docking member so that air is captured within the trough when the docking member is positioned in the water.

9. The floating dock of claim 7 wherein the bottom of the docking member comprises a plurality of hollow troughs.

10. The floating dock as in claim 1, comprising:

(a) at least one pole bracket having a top and a bottom and a cylindrical hole extending from the top to the bottom of the bracket; and (b) a flange connected to said pole bracket complementary in shape to the receiving socket of the docking member.

11. The floating dock as in claim 10 wherein the top of each docking member contains a hole positioned above the receiving socket, and a securing means is positioned through the hole in the top of the docking member and extended downward into the flange of the pole bracket to detachably secure such members together.

12. The floating dock of claim 11 wherein the securing means is associated with a nut positioned in the flange of the pole bracket.

13. The floating dock as in claim 10 wherein the pole bracket comprises one unit made of polyethylene.

* * * * *